US008839956B2

(12) United States Patent
Roehm et al.

(10) Patent No.: US 8,839,956 B2
(45) Date of Patent: Sep. 23, 2014

(54) SYSTEM MODULE OF A STORAGE SYSTEM

(71) Applicant: Robert Bosch GmbH, Stuttgart (DE)

(72) Inventors: Heiko Roehm, Stuttgart (DE); Dietmar Saur, Gomaringen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/021,330

(22) Filed: Sep. 9, 2013

(65) Prior Publication Data

US 2014/0076759 A1 Mar. 20, 2014

(30) Foreign Application Priority Data

Sep. 17, 2012 (DE) ..... 10 2012 216 485

(51) Int. Cl.
*B65D 85/28* (2006.01)
*B25H 3/02* (2006.01)

(52) U.S. Cl.
CPC ..... *B25H 3/026* (2013.01)
USPC ..... 206/373

(58) Field of Classification Search
CPC ..... B25H 3/023
USPC ..... 206/372, 373, 349, 509
See application file for complete search history.

(56) References Cited

U.S. PATENT DOCUMENTS

| | | | | |
|---|---|---|---|---|
| 2,124,071 | A * | 7/1938 | Loftin | 312/199 |
| 4,619,363 | A * | 10/1986 | Wolfseder | 206/373 |
| 5,325,966 | A * | 7/1994 | Chang | 206/372 |
| 6,817,495 | B1 * | 11/2004 | Luck | 222/626 |
| 7,077,267 | B2 * | 7/2006 | Lee | 206/373 |
| 2006/0108245 | A1 * | 5/2006 | Lee | 206/373 |
| 2007/0159040 | A1 * | 7/2007 | Fernandez et al. | 312/348.3 |
| 2010/0230313 | A1 * | 9/2010 | Allan et al. | 206/373 |
| 2012/0312708 | A1 * | 12/2012 | Roehm et al. | 206/349 |

FOREIGN PATENT DOCUMENTS

DE 10 2008 058 007 B3 4/2010

* cited by examiner

*Primary Examiner* — Steven A. Reynolds
*Assistant Examiner* — King M Chu
(74) *Attorney, Agent, or Firm* — Maginot, Moore & Beck

(57) ABSTRACT

A system module of a storage system includes at least one frame unit, at least one first function unit, at least one second function unit, and at least one positioning unit. The at least one frame unit has at least one coupling unit configured to be coupled, so as to be disconnectable by an operator, to at least one part of at least one further system module. The function units are configured to be disposed, at least in one operating state, at least substantially inside a space spanned by the frame unit. The at least one positioning unit is configured to position the function units, independently of each other, relative to the frame unit, in at least two at least substantially differing positions.

18 Claims, 2 Drawing Sheets

SYSTEM MODULE OF A STORAGE SYSTEM

This application claims priority under 35 U.S.C. §119 to patent application no. DE 10 2012 216 485.5, filed on Sep. 17, 2012 in Germany, the disclosure of which is incorporated herein by reference in its entirety.

BACKGROUND

There has already been proposed, in DE 10 2008 058 007 B3, a system module of a hand-tool storage system having at least one coupling unit, which is provided to be coupled, so as to be disconnectable by an operator, to at least one part of at least one further system module.

SUMMARY

There is proposed a system module of a storage system, in particular of a hand-tool storage system, comprising at least one frame unit, which has at least one coupling unit, which is provided to be coupled, so as to be disconnectable by an operator, to at least one part, in particular a coupling unit, of at least one further system module, and comprising at least one first and one second function unit that, at least in one operating state, are disposed at least substantially inside a space spanned by the frame unit, and comprising at least one positioning unit, which is provided to position the function units independently of each other, relative to the frame unit, in at least two at least substantially differing positions. A "storage system" is to be understood to mean, in particular, a system comprising various storage means and, in particular, system modules that are provided to be transported connected to each other. Preferably, the storage system has at least one tool box, realized according to the publication DE 10 2008 058 007 B3. Also conceivable are other functions of the storage system that are considered appropriate by persons skilled in the art. In a particularly preferred exemplary embodiment, the storage system is configured such that it can be optionally expanded by means of further system modules. The system modules may preferably be constituted by a frame, a box, a shelf, a further frame unit, or by similar elements, considered appropriate by persons skilled in the art, that are configured to be compatible with the storage system. In particular, a "hand-tool storage system" is to be understood to mean a storage system provided to store at least one hand tool, a hand-tool battery and/or accessories of a hand tool. A "frame unit" in this context is to be understood to mean, in particular, a unit having at least three side elements that constitute a closed contour and enclose a defined space. In a particularly preferred exemplary embodiment, four interconnected side walls, disposed perpendicularly in relation to each other, are provided. Preferably, at least one of the two further sides, which are disposed perpendicularly in relation to the at least three, in particular four, side walls, are of an open configuration, wherein "of an open configuration" in this context is to be understood to mean, in particular, that, in configuration of the frame unit, a base wall and/or cover wall was deliberately omitted. Particularly preferably, the frame unit is configured at least substantially as a single piece. Preferably, the frame unit has a frame element made of a metal and/or, particularly preferably, of a plastic such as, for example, PA6, ABS, PC, PP and/or another plastic considered appropriate by persons skilled in the art. In a particularly preferred exemplary embodiment, the frame unit at least partially encloses a function-unit receiving region for receiving the function units. Preferably the frame unit is at least substantially dimensionally stable if properly used, in particular in the case of transport of an item in the receiving region, and in the case of storage and stacking. This means, in particular, that the frame unit, if properly used, becomes deformed, in particular elastically, by less than 20%, advantageously by less than 5%, of a main extent of the frame unit. Advantageously, the frame unit has at least one standing surface provided to enable secure standing, at least on an inclined plane having a slope of at least 10 degrees. Preferably, at least the standing surface is slip resistant and/or preferably protected against impact. Advantageously, through simple configuration means, the frame unit enables the function units, when in an assembled state, to be protected against mechanical action. A "coupling unit" is to be understood to mean, in particular, a unit provided to mechanically fasten the further system module, advantageously, to a box lid and/or, particularly advantageously, to a box body of the system module, in particular for transport. Preferably, the system module has two coupling units, which are provided, respectively, to fasten a further system module on opposite sides. Preferably, the coupling unit is realized as described in DE 10 2008 058 007 B3. Advantageously, the frame unit has further coupling units, in particular for coupling to a shelf system. In particular, a "coupling that is disconnectable by an operator" is to be understood to mean a mechanical connection that can be disconnected by the operator in a non-destructive manner and, advantageously, without the use of tools. Preferably, the coupling unit is latched to the part of the further system module. Preferably, the coupling unit and/or the part of the further system module has an operating element, the actuation of which disconnects the coupling. "Provided" is to be understood to mean, in particular, specially programmed, configured and/or equipped. A "function unit" is to be understood to mean, in particular, a unit provided to perform a main function in an operating state, in particular in a state in which the function unit is fastened, at least substantially, in the frame unit, or is connected to the frame unit. The function unit is preferably configured so as to be at least substantially different from a hand tool and/or from a hand power tool. Preferably, the function unit has at least one function considered appropriate by persons skilled in the art. The function unit may advantageously comprise a charging appliance, a metering appliance, a levelling device, an energy output, in particular a socket outlet, a vacuum cleaner, a media reproduction appliance, in particular a radio, and/or, advantageously, a lighting means. In a further configuration of the disclosure, the system module has more than two function units that can be positioned differently in relation to the frame unit. In particular, the terms "spanned space" in this context is to be understood to mean the space defined by a contour of the frame unit. Particularly preferably, the space is configured such that it is open on at least one side, preferably on at least two sides, and is at least substantially freely accessible by an operator. The function units can be inserted, in particular without the use of tools, in the space. Particularly preferably, the function units, when in an inserted, operationally ready state, are disposed at least partially, preferably at least substantially completely, inside the space spanned by the frame unit. "Substantially inside" is to be understood to mean, in particular, that the function units, in at least one operating state, are disposed by at least 50%, advantageously by at least 75%, particularly advantageously by 100% inside the space spanned by the frame unit. A "positioning unit" in this context is to be understood to mean, in particular, a unit provided, at least substantially, to achieve a positioning of the function units, relative to the frame unit, in at least two differing positions. Preferably, the positioning unit has at least one joint, about which the at least one of the function units can be pivoted and/or rotated, about at least one axis or, in particular, about at least two axes. For example, the joint is realized as a ball joint, particularly preferably as pivot joint. The positioning unit is preferably connected to the function units and/or the frame unit so as to be disconnectable, in particular by an operator. In particular, the positioning unit is connected, at least partially, to the function units and/or the frame unit in a preferably rotatably movable manner. Advantageously, the positioning unit is provided to hold the function unit in at least two locking positions relative to the frame unit. In a particularly preferred exemplary embodiment, the positioning unit is provided to achieve at least three, preferably at least four, particularly preferably at least five mutually differing locking positions of the function units relative to the frame unit. Particularly preferably, any number of locking positions of the function units relative to the frame unit can be achieved within a defined range by means of the positioning unit. "At least substantially differing positions" in this context is to be understood to mean, in particular, a difference of at least 1 mm, preferably of at least 5 mm, and particularly preferably of at least 10 mm between the at least two positions in at least one, preferably in at least two, and particularly preferably in at least three, spatial directions. In a particularly preferred exemplary embodiment, the difference between a first position and at least one second position is at least 25 mm. If the positioning unit is provided to pivot the function unit about at least one axis, "at least substantially differing positions" is to be understood to mean a difference of at least 2 degrees, advantageously 5 degrees, particularly advantageously 10 degrees. "Independently of each other" in this context is to be understood to mean, in particular, that the positioning unit is provided to position the function units in differing alignments relative to the frame unit. In particular, the term "position" is to be understood to mean, to fix in a position relative to the frame unit. The configuration of the system module according to the disclosure enables a plurality of functions to be performed, by advantageously protected function units, in an advantageously aligned manner.

In a further configuration, it is proposed that the function units be provided to perform their function independently of each other, thereby rendering possible a structurally simple configuration. In particular, there is no need for elaborate cabling between the two function units. In particular, the expression "perform their function independently of each other" is to be understood to mean that the first function unit and the second function unit are functionally separate from each other in their operation. In particular, the function units have separate operating elements and/or separate energy supply systems. Advantageously, the function units perform differing functions. Alternatively or additionally, the function units could perform the same function, in particular directed at differing areas. For example, both function units could be realized as lamps, by which working areas can be directly and/or indirectly illuminated. Alternatively, the function units could interact with each other.

It is furthermore proposed that the positioning unit be provided to fasten at least one of the function units so as to be disconnectable by an operator, thereby enabling the function unit to be used separately from the frame unit. The expression "fasten so as to be disconnectable by an operator" is to be understood to mean, in particular, that the positioning unit and the function units are connected in such a manner that an operator can disconnect the connection in a non-destructive manner and, advantageously, without the use of tools. Preferably, the positioning unit fastens both function units so as to be disconnectable by an operator.

It is additionally proposed that the positioning unit be provided to hold the function units in their respective position by means of a frictional fit and/or by means of a form-fit, such that, through simple configuration means, they can be fastened in a working position. A "frictional fit" is to be understood to mean, in particular, a fastening by means of a static friction. For example, the positioning unit could have a thread or an eccentric that presses the two frictional surfaces against each other. In particular, the term "form-fit" is to be understood to mean a fastening by means of a geometric configuration. For example, the positioning unit could have a latching means, a toothing and/or, advantageously, an oblique toothing.

It is additionally proposed that the positioning unit have at least two holding links, which are provided to hold the function units in the respective position, thereby rendering possible a particularly stable fastening. A "holding link" is to be understood to mean, in particular, a means that, in at least one operating state, at a distance from the rotation axis of the function units, effects a holding force, in particular a linear holding force, between the frame unit and respectively one of the function units, which holding force holds the function units in the respective position.

It is furthermore proposed that the system module comprise a connecting unit, which is provided, in at least one operating state, to connect the function units such that they can be positioned jointly, whereby, in a particularly simple manner, the function units can be given the same alignment. In particular, "jointly positionable" is to be understood to mean that, when the connecting unit is closed, a movement of the one function unit causes a movement of the other function unit, in particular by the same angle.

In an advantageous development of the disclosure, it is proposed that at least one of the function units have a function means and/or operating means that can be actuated only if this function unit is positioned at least partially outside of the space spanned by the frame unit, as a result of which the function means and/or operating means is advantageously protected. A "function means and/or operating means" in this context is to be understood to mean, in particular, a means that performs a function through interaction with the operator and/or via which the operator can control a function. In particular, "can be actuated" is to be understood to mean that the operator can interact only if a function unit has been moved out of the space, in the manner provided.

In a further configuration, it is proposed that at least the function means and/or operating means be realized as a battery interface, thereby making it possible to provide an energy supply that is well protected and independent of a mains power supply network. A "battery interface" is to be understood to mean, in particular, an interface provided to take up electrical energy from a hand-tool battery and to discharge it to a function means of the function units. Preferably, a connection between the hand-tool battery and the battery interface is realized so as to be disconnectable by an operator in a non-destructive manner and, in particular, without the use of tools.

Advantageously, the hand-tool battery can be removed from the battery interface only if this function unit is positioned at least partially outside of the space spanned by the frame unit. Preferably, each of the function units has a function means realized as a battery interface, such that, through simple configuration means, the two function units can be supplied with differing voltages. Preferably, the function units are provided to be supplied with differing voltages having an operating energy.

It is furthermore proposed that the function units at least substantially completely fill the space spanned by the frame unit. "At least substantially completely fill" in this context is to be understood to mean, in particular, that the function unit fills the space spanned by the frame unit by at least 50%, preferably by at least 70%, and particularly preferably by at least 80%. In a particularly preferred exemplary embodiment, the function unit fills the space spanned by the frame unit by at least 95%. This makes it possible to achieve an advantageously compact and space-saving configuration of the system module according to the disclosure.

The storage system according to the disclosure in this case is not intended to be limited to the application and embodiment described above. In particular, the storage system according to the disclosure, for the purpose of implementing a functioning mode described herein, can have a number of individual elements, components and units that differs from a number stated herein.

BRIEF DESCRIPTION OF THE DRAWINGS

Further advantages are given by the following description of the drawing. The drawing shows an exemplary embodiment of the disclosure. The drawings and the description contain numerous features in combination. Persons skilled in the art will also expediently consider the features individually and combine them to create appropriate further combinations.

In the drawing.

DETAILED DESCRIPTION

Figure 1:
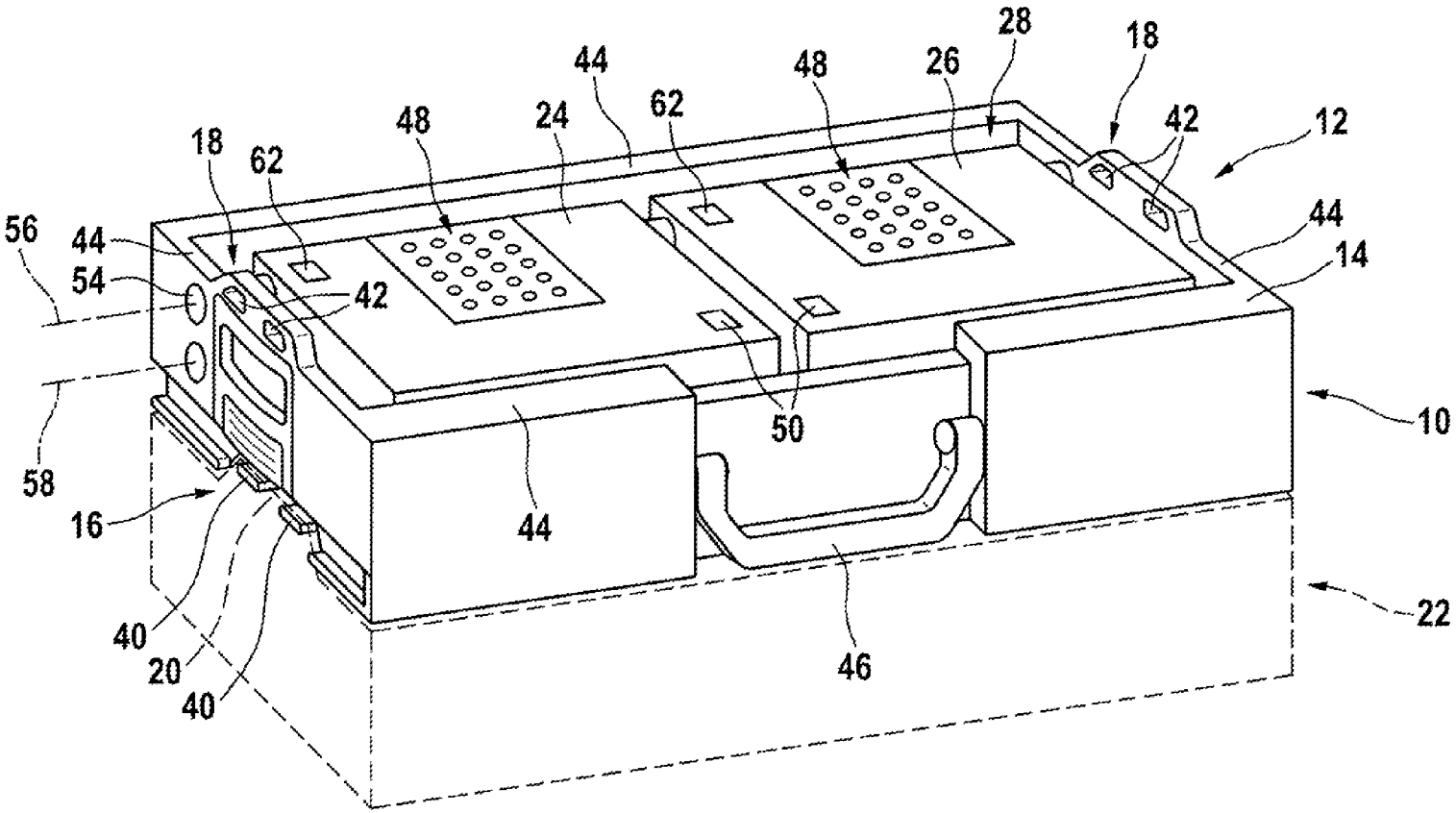
FIG. 1 shows a system module according to the disclosure of a storage system having two folded-in function units.
Figure 2:
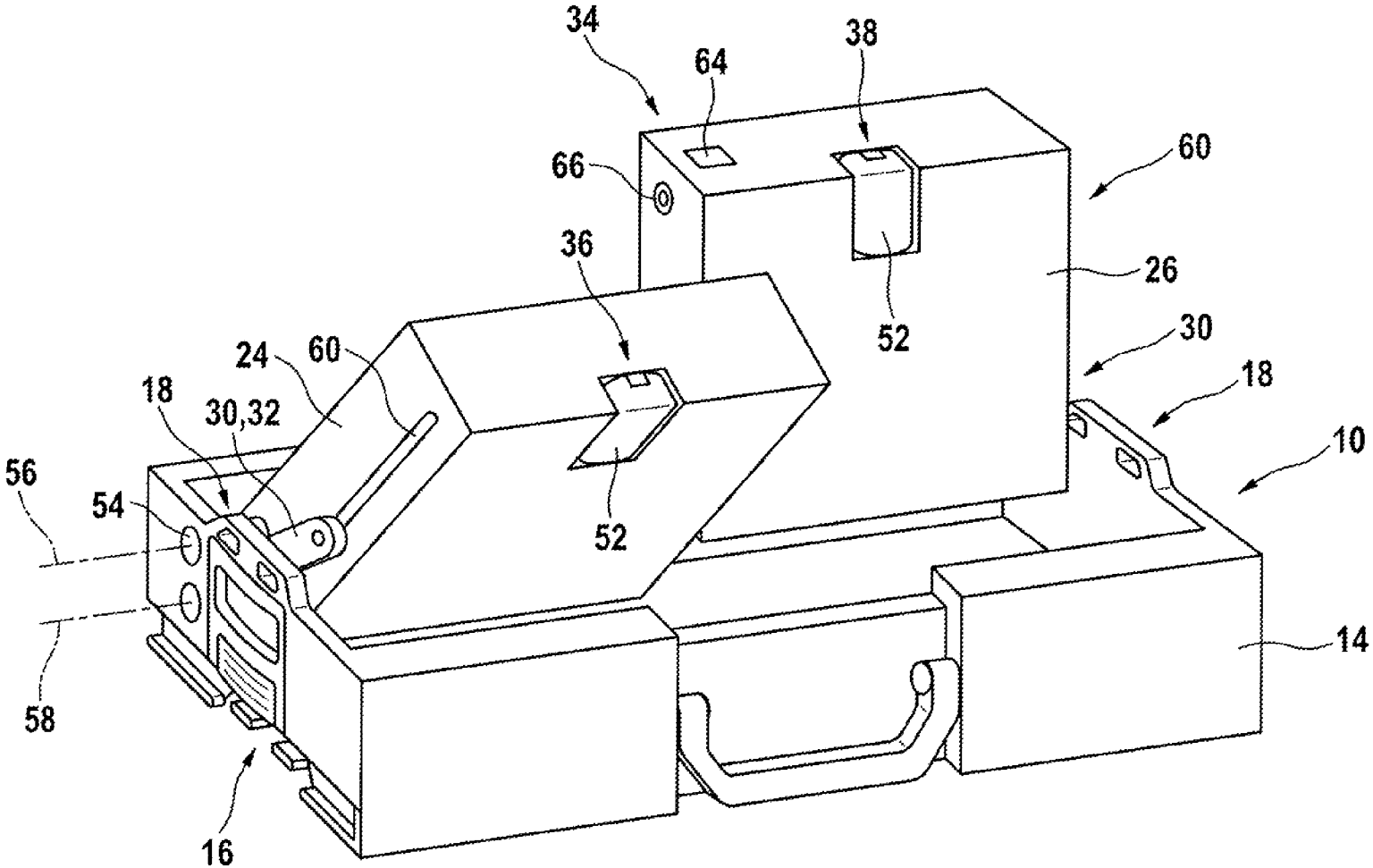
FIG. 2 shows the system module from FIG. 1, with folded-out function units.

FIGS. 1 and 2 show a storage system 12, having a first system module 10 according to the disclosure and a second system module 22 according to the disclosure. The second system module 22 is represented schematically, and is realized as a hand-tool box. The first system module 10 has a frame unit 14 having a first coupling unit 16 and a second coupling unit 18. The first coupling unit 16 is provided for coupling the second system module 22 on an underside of the first system module 10 so as to be disconnectable by an operator. The second coupling unit 18 is provided for coupling a further system module, not represented in greater detail here, on a top side of the first system module 10 so as to be disconnectable by an operator. The first coupling unit 16 has latching hooks 40 that, when in a connected operating state, are latched into latching recesses of a part 20 of the second system module 22. The second coupling unit 18 has latching recesses 42 into which latching hooks of the further system module can latch, when in a connected operating state.

The frame unit 14 comprises four side walls 44, which delimit on four sides a space 28 spanned by the frame unit 14. The frame unit 14 does not delimit a top side and an underside of the spanned space 28. The frame unit 14 additionally has a handle 46. A side of the frame unit 14 that faces away from the handle 46 is realized as a standing surface. The system module 10 comprises a first and a second function unit 24, 26, which, in the folded-in operating state represented in FIG. 1, are disposed completely in the space 28 spanned by the frame unit 14. The function units 24, 26 substantially completely fill the space 28 spanned by the frame unit 14. There is an air gap between the frame unit 14 and the function units 24, 26. In addition, there is an air gap between the function units 24, 26.

The function units 24, 26 comprise, respectively, a first function means 36, 38, a second function means 48 and an operating means 50. The first function means 36, 38 are realized as battery interfaces. They are provided for coupling to a respective hand-tool battery 52. The first function means 36, 38 can be actuated only if the respective function unit 24, 26 is positioned at least partially outside of the space 28 spanned by the frame unit 14. The first function means 36, 38 respectively provide one of the second function means 48 with electrical energy. The second function means 48 are realized as LED lighting means. The second function means 48 of the two function units 24, 26 are provided to illuminate at differing angles of radiation. One of the second function means 48 is optimized for direct illumination, and one of the second function means 48 is optimized for indirect illumination. The function units 24, 26 perform their function independently. If the system module 10 is standing with the underside or top side on a level surface, the function units 24, 26, when in a folded-in operating state, are at a distance from the surface.

The system module 10 has a positioning unit 30, which is provided to position the function units 24, 26 in multiple differing positions, independently of each other, relative to the frame unit 14. For this purpose, the positioning unit 30 comprises two holding links 32 and a joint means 54. The joint means 54 mounts the function unit 24, 26 such that they are rotatable about a rotation axis 56. The function units 24, 26 can be folded out of the frame unit 14, through the open top side of the frame unit 14. The joint means 54 runs parallelwise in relation to one of the side walls 44 of the frame unit 14. The joint means 54 is disposed closer to the top side of the frame unit 14 than to an underside of the frame unit 14. The joint means 54 mounts the function units 24,26 such that they can be pivoted about the same rotational axis 56. Alternatively, a positioning unit could be provided to fasten the function units 24, 26 such that they can be pivoted about mutually differing axes or points.

The holding links 32 are provided to hold the function units 24, 26 in the differing settable positions. The holding links 32 are connected to the frame unit 14 on one side so as to be rotatable about a rotational axis 58, beneath the joint means 54. On the other side, the holding links 32 are connected to a groove 60 of respectively one of the function units 24, 26. On their inside, the grooves 60 have a corrugated shape, by which the function units 24, 26 are fixed in the various settable positions by means of a form-fit and frictional fit so as to be disconnectable by the operator without the use of tools. In addition, the positioning unit 30 could have operating elements to be actuated for the purpose of disconnecting the fixing of the positioning unit 30.

The positioning unit 30 is provided to fasten the function units 24, 26 so as to be disconnectable by an operator without the use of tools. For this purpose, the function units 24, 26 each have a removal means 62. By means of the removal means 62, a connection between the function units 24, 26 and the frame unit 14 can be separated by an operator without the use of tools.

The function units 24, 26 each have a part of a connecting unit 34 that is provided, at least in one operating state, to connect the function units 24, 26 such that they can be positioned jointly. The connecting unit 34 comprises an operating means 64, a first form-fitting element, which is concealed in this case, and a second form-fitting element 66. The first form-fitting element is disposed on the first function unit 24. In this exemplary embodiment, the operating means 64 and the second form-fitting element 66 are disposed on the second function unit 26. When in a connected operating state, the second form-fitting element 66 is displaced, by means of the operating means 64, such that it is mechanically connected to the first form-fitting element.

What is claimed is:

1. A system module of a storage system, comprising:

at least one frame unit having at least one coupling unit configured to be coupled, so as to be disconnectable by an operator, to at least one part of at least one further system module;

at least one first function unit and at least one second function unit configured to be disposed, at least in one operating state, at least substantially inside a space spanned by the at least one frame unit; and at least one positioning unit configured to position the at least one first function unit and the at least one second function unit independently of each other, relative to the at least one frame unit, in at least two at least substantially differing positions, wherein at least one of the at least one first function unit and the at least one second function unit has a battery interface.

2. The system module according to claim 1, wherein the at least one first function unit and the at least one second function unit are configured to function independently of each other.

3. The system module according to claim 1, wherein the at least one positioning unit is configured to fasten at least one of the at least one first function unit and the at least one second function unit so as to be disconnectable by an operator.

4. The system module according to claim 1, wherein the at least one positioning unit is configured to hold the at least one first function unit and the at least one second function unit in respective positions by at least one of a frictional fit and a form-fit.

5. The system module according to claim 1, wherein the at least one positioning unit has at least two holding links configured to hold the at least one first function unit and the at least one second function unit in position.

6. The system module according to claim 1, further comprising:

a connecting unit configured to connect, in at least one operating state, the at least one first function unit and the at least one second function unit such that the at least one first function unit and the at least one second function unit are jointly positionable.

7. The system module according to claim 1, wherein at least one of the at least one first function unit and the at least one section function unit has at least one of a function mechanism and an operating mechanism configured to be actuated only if the at least one of the at least one first function unit and the at least one second function unit is positioned at least partially outside of the space spanned by the at least one frame unit.

8. The system module according to claim 1, wherein the at least one first function unit and the at least one second function unit are configured to at least substantially completely fill the space spanned by the at least one frame unit.

9. A storage system, comprising:

a system module, including:

at least one frame unit;

at least one first function unit and at least one second function unit configured to be disposed, at least in one operating state, at least substantially inside a space spanned by the at least one frame unit; and at least one positioning unit configured to position the at least one first function unit and the at least one second function unit independently of each other, relative to the at least one frame unit, in at least two at least substantially differing positions; and at least one further system module, wherein the at least one frame unit has at least one coupling unit configured to be coupled, so as to be disconnectable by an operator, to at least one part of the at least one further system module, and wherein at least one of the at least one first function unit and the at least one second function unit has a battery interface.

10. A system module of a storage system, comprising:

at least one frame unit having at least one coupling unit configured to be coupled, so as to be disconnectable by an operator, to at least one part of at least one further system module;

at least one first function unit and at least one second function unit configured to be disposed, at least in one operating state, at least substantially inside a space spanned by the at least one frame unit; and at least one positioning unit configured to mount the at least one first function unit and the at least one second function unit to the at least one frame unit at a common rotation axis so as to be rotatable about the common rotation axis, the at least one first function unit positionable at a first angle about the common rotation axis and the at least one second function unit positionable at a second angle about the common rotation axis, the first angle substantially differing from the second angle.

11. The system module according to claim 10, wherein the at least one first function unit and the at least one second function unit are configured to function independently of each other.

12. The system module according to claim 10, wherein the at least one positioning unit is configured to hold the at least one first function unit at the first angle and the at least one second function unit at the second angle by at least one of a frictional fit and a form-fit.

13. The system module according to claim 10, further comprising:

a connecting unit configured to connect, in at least one operating state, the at least one first function unit and the at least one second function unit such that the at least one first function unit and the at least one second function unit are jointly positionable and the first angle is the same as the second angle.

14. The system module according to claim 10, wherein at least one of the at least one first function unit and the at least one section function unit has at least one of a battery interface and an LED lighting mechanism configured to be actuated only if the at least one of the at least one first function unit and the at least one second function unit is positioned at least partially outside of the space spanned by the at least one frame unit.

15. The system module according to claim 10, wherein the at least one first function unit and the at least one second function unit are configured to at least substantially completely fill the space spanned by the at least one frame unit.

16. The system module according to claim 10, wherein the at least one first function unit includes at least one of a charging appliance, a metering appliance, a media reproduction outlet, an energy output, and a light unit.

17. The system module according to claim 10, further comprising a joint unit configured to mount the at least one first function unit and the at least one section function unit such that the at least one first function unit and the at least one second function unit are rotatable about the common rotation axis.

18. The system module according to claim 10, wherein the at least one positioning unit has at least two holding links configured to hold the at least one first function unit and the at least one second function unit in position.

* * * * *